United States Patent [19]

Beneke

[11] 4,366,601

[45] Jan. 4, 1983

[54] CARD SCREEN

[75] Inventor: Wolfgang Beneke, Monchen-Gladbach, Fed. Rep. of Germany

[73] Assignee: Trützschler GmbH & Co. KG, Monchen-Gladbach, Fed. Rep. of Germany

[21] Appl. No.: 199,812

[22] Filed: Oct. 23, 1980

[30] Foreign Application Priority Data

Oct. 26, 1979 [DE] Fed. Rep. of Germany ..... 2943343

[51] Int. Cl.[3] ..... D01G 15/34

[52] U.S. Cl. ..... 19/98; 19/95; 19/105

[58] Field of Search ..... 19/95, 98, 99, 105, 19/107

[56] References Cited

U.S. PATENT DOCUMENTS

| | | | |
|---|---|---|---|
| 2,737,689 | 3/1956 | Hunter | 19/99 |
| 3,169,278 | 2/1965 | Aoki | 19/105 |
| 3,685,099 | 8/1972 | Jenkins | 19/95 |
| 4,008,511 | 2/1977 | Oda | 19/105 |
| 4,224,717 | 9/1980 | Teichmann et al. | 19/98 |

FOREIGN PATENT DOCUMENTS

| | | | |
|---|---|---|---|
| 1467276 | 12/1966 | France | 19/105 |

*Primary Examiner*—Louis Rimrodt
*Attorney, Agent, or Firm*—Spencer & Kaye

[57] ABSTRACT

A carding machine has a carding cylinder, a lickerin cooperating with the carding cylinder and defining a corner zone therewith and a card screen extending underneath the carding cylinder including the corner zone. The card screen has a screen face which is oriented towards the carding cylinder and which has a throughgoing slot in the vicinity of the corner zone. The slot extends over the screen width and constitutes the sole discontinuity in the screen face.

5 Claims, 3 Drawing Figures

CARD SCREEN

BACKGROUND OF THE INVENTION

This invention relates to a screen for a carding machine. The screen which extends generally underneath the carding cylinder, has a central part and two end parts. One of the end parts projects into the zone between the lickerin and the carding cylinder. An additional screen is arranged underneath the lickerin.

In practice the screen extending underneath the carding cylinder is made of several sections for manufacturing reasons. The central part of the screen is provided with screen bars, while the two end parts are free from such screen bars. The known screen of the above-outlined type has, in essence, three functions: it separates waste, it equalizes excess air pressure and it guides the fibers. In the known arrangement, underneath the carding cylinder two cylinder screen parts adjoin the lickerin screen which projects into the corner zone between the lickerin and the carding cylinder. The cylinder screen part which joins the lickerin screen as well as the cylinder screen half which is situated in the vicinity of the doffer are provided with closed sheet metal portions corresponding to a screen length having about 20 screen bars. Between these screen parts there are situated the screen bars which are spaced from one another at a distance which corresponds to one-half of one bar width. Such a known screen structure, as noted above, serves for guiding the fibers and for simultaneously regulating the pressure of the entrained air as well as for separating the waste as well as fiber fragments or short fibers no longer used in the successive steps of the spinning process.

It is a disadvantage of card screens of the above-outlined type that they do not process satisfactorily short fibers because the latter are caught in the clearance between the screen bars and form a packed, chunky mass. As carding operation is started, the screen clothing tears these chunks away and squeezes them into the clearance between the clothing of the carding cylinder and the screen, resulting in a damage to the cylinder screen. Also, the risks are high that the entrained fiber chunks press the lickerin screen against the lickerin clothing.

SUMMARY OF THE INVENTION

It is an object of the invention to provide an improved card screen of the above-outlined type from which the discussed disadvantages are eliminated and which is particularly adapted for processing short and very short fibers and which prevents the formation of fiber chunks.

These objects and others to become apparent as the specification progresses, are accomplished by the invention, according to which, briefly stated, the screen surface is closed (that is, it has no grate portion) throughout its entire length and further, the end part of the screen which is associated with the lickerin has a transverse, slot-like opening extending along the entire width of the screen.

As shown, the carding screen generally serves to close off the downwardly open regions of the lickerin and the carding cylinder. By virtue of the throughout-closed screen surface as provided according to the invention, short fibers can be guided without difficulty and such fibers can no longer settle in the slot between the screen bars. It is an important result of this arrangement that a processing of pure short fibers is feasible so that a separation of waste is no longer necessary. In order to reduce the excessive air pressure which builds up between the cylinder clothing and the closed smooth screen surface, the end part of the screen associated with the lickerin has a slot-like opening over its entire width. In the absence of such a slot the screen would bend which could result in the buildup of fiber chunks that would lead to an operational breakdown of the card. The carding screen according to the invention may replace the conventional, existing card screens in carding machines.

According to a further feature of the invention, the width of the slot-like opening provided in the card screen is variable, whereby the air pressure between the screen and the cylinder can be regulated. Preferably, the width of the slot-like opening is variable between approximately 8 and 15 mm. By virture of the adjustability of the slot, there can be set an optimum width for the processing of short fibers of different fiber types and lengths.

According to a further feature of the invention, the slot-like opening is situated at a distance of approximately 100 to 200 mm from that end of the card screen which is in the vicinity of the lickerin. Preferably, the slot-like opening has, in a direction oriented away from the cylinder, an enlarged portion so that it has cross-sectionally a wedge-shaped configuration which enhances the expansion of the exiting air stream.

DESCRIPTION OF THE PREFERRED EMBODIMENT

Figure 1:
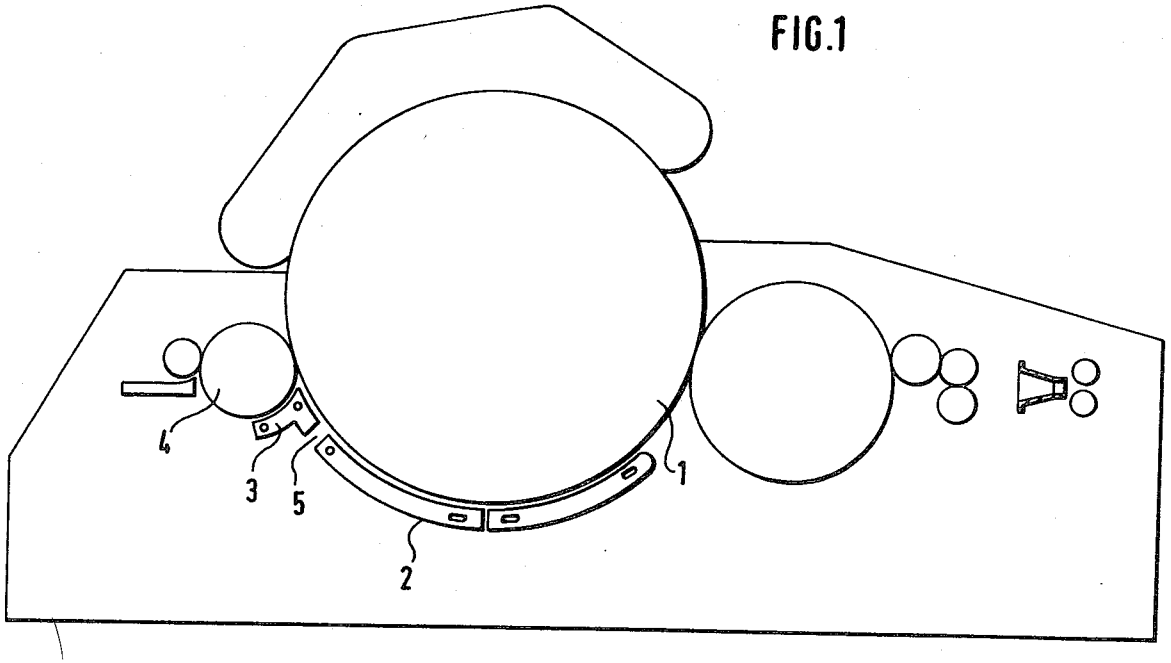
FIG. 1 is a schematic sectional side elevational view of a carding machine incorporating a preferred embodiment of the invention.
Figure 2:
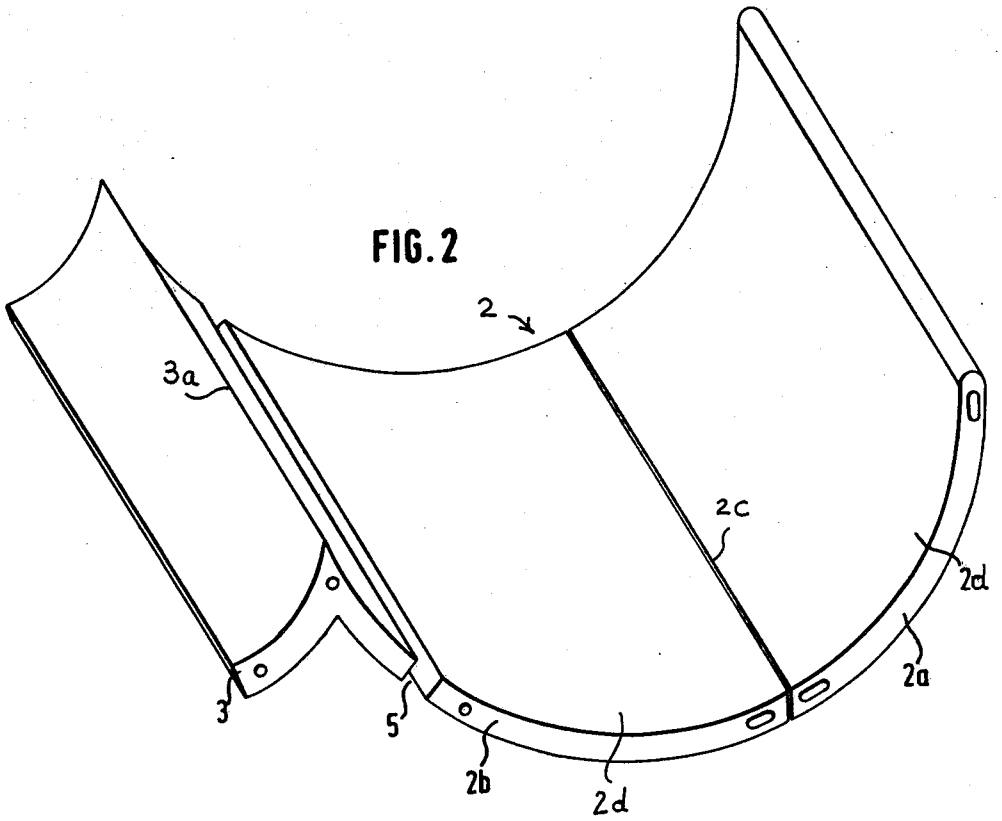
FIG. 2 is a perspective view of a preferred embodiment of the invention.

Turning now to FIG. 1, there is schematically illustrated a carding machine including a carding cylinder 1 and a lickerin 4. Under the two components 1 and 4 there extends a screen essentially comprising a cylinder screen 2 and a corner part 3, as also shown in the perspective FIG. 2. The cylinder screen 2, in turn, is composed of two screen halves 2*a* and 2*b* which meet along a hermetically sealing butt joint 2*c*. The screen 2 is a two-part structure for manufacturing considerations, since its making of a single piece involves significant technical difficulties. The cylinder screen half 2*b* is adjoined by the closed corner piece 3 which projects into the wedge-shaped zone formed by the cylinder 1 and the lickerin 4. Underneath the lickerin 4, adjacent the corner piece 3, there may be arranged various separating knives, lickerin elements, closed screen elements or the like. The inner face 2*d* of the screen 2 is continuous and is entirely closed. That end of the screen 2 which is associated with the lickerin 4 and which reaches to edge 3*a* defines a slot-like opening 5 extending over the entire width of the screen. The slot 5 serves as a ventilating opening to ensure that the prevailing conditions of air pressure are not disturbed, that is, to prevent air and thus fiber waste and other fragments from exiting laterally. The width of the slot-like opening 5 can be adjusted by elements not shown. The width of the opening 5 is variable between approximately 8–15 mm. The slot-like opening 5 is situated at a distance of approximately 100 to 200 mm from the edge 3*a* of the wedge-shaped corner piece 3.

Figure 3:
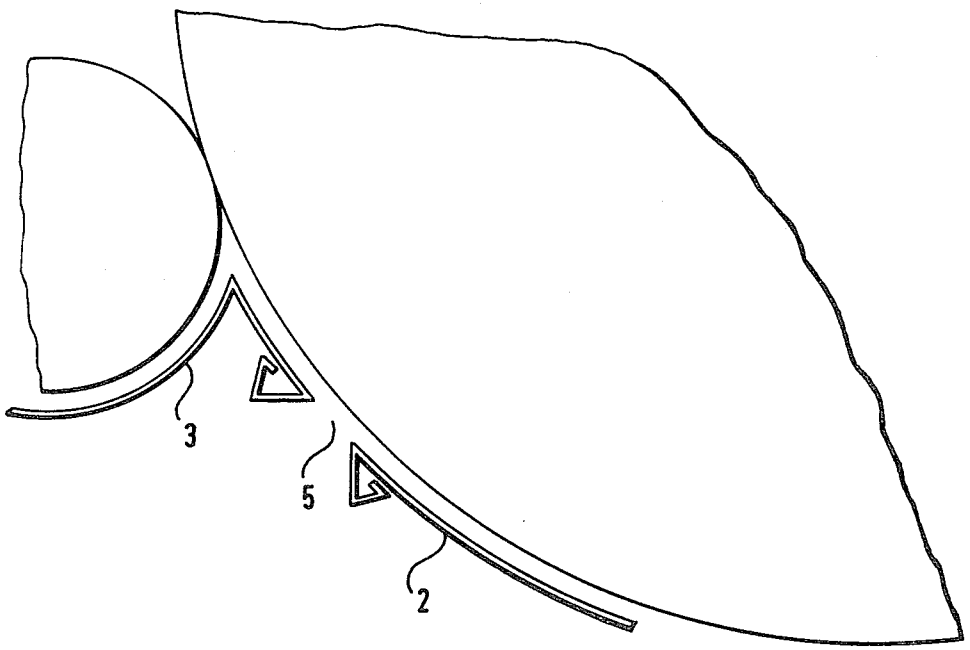
FIG. 3 is a schematic sectional elevational view of one part of the preferred embodiment.

Turning now to FIG. 3, the slot-like opening 5 is enlarged in a direction oriented away from the cylinder 1. This prevents fibers, dust, etc., exiting through the opening from jamming the outlet.

It is further noted that the screen halves 2*a*, 2*b* may be segmented sheet metal parts (not shown) which start and terminate with inward-turned edges and are coupled to one another to form closed cylinder screen halves. The inward-turned edges increase the form-stability of the screen.

It will be understood that the above description of the present invention is susceptible to various modifications, changes and adaptations, and the same are intended to be comprehended within the meaning and range of equivalents of the appended claims.

What is claimed is:

1. In a carding machine including a carding cylinder, a lickerin cooperating with the carding cylinder and defining a corner zone therewith, a first card screen extending underneath the carding cylinder and having a screen face oriented towards the carding cylinder and having a length extending substantially parallel to the circumference of the carding cylinder and a width extending perpendicularly to the length of the screen face; said first card screen having an end situated in said corner zone; and a second card screen extending from said end of said first screen underneath said lickerin; the improvement comprising means defining a throughgoing slot in said first screen in the vicinity of said corner zone; said slot being spaced from said end and extending over said width in a direction parallel thereto; and further wherein said slot constitutes the sole discontinuity in said face of said first card screen.

2. A carding machine as defined in claim 1, wherein said slot has a width measured parallel to the length of said screen face and further wherein said width of said slot is variable.

3. A carding machine as defined in claim 2, wherein said width of said slot is variable between approximately 8 and 15 mm.

4. A carding machine as defined in claim 7, wherein said slot is situated at a distance of approximately 100 to 200 mm from said end of said first screen.

5. A carding machine as defined in claim 1, wherein said slot has a width measured parallel to the length of said screen face and further wherein said width of said slot increases as viewed in a direction away from said carding cylinder.

* * * * *